US007493960B2

(12) United States Patent
Leising et al.

(10) Patent No.: US 7,493,960 B2
(45) Date of Patent: Feb. 24, 2009

(54) APPARATUS AND METHOD TO CONNECT TWO PARTS WITHOUT ROTATION

(75) Inventors: Lawrence J. Leising, Missouri City, TX (US); Howard L. McGill, Lufkin, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 297 days.

(21) Appl. No.: 11/533,181

(22) Filed: Sep. 19, 2006

(65) Prior Publication Data

US 2007/0062707 A1 Mar. 22, 2007

Related U.S. Application Data

(60) Provisional application No. 60/718,812, filed on Sep. 20, 2005.

(51) Int. Cl.
*E21B 17/02* (2006.01)

(52) U.S. Cl. ..... 166/380; 166/242.6; 285/330

(58) Field of Classification Search ..... 166/242.6, 166/380; 285/330
See application file for complete search history.

(56) References Cited

U.S. PATENT DOCUMENTS

| | | | | | |
|---|---|---|---|---|---|
| 2,296,198 | A * | 9/1942 | Boynton | 285/91 |
| 2,843,399 | A * | 7/1958 | Arterbury et al. | 285/3 |
| 4,181,210 | A | 1/1980 | Bibbens | |
| 4,512,596 | A * | 4/1985 | Obrecht | 285/81 |
| 4,762,452 | A | 8/1988 | Vogel | |
| 5,269,572 | A * | 12/1993 | Mefferd | 285/330 |
| 5,415,441 | A * | 5/1995 | Kilgore et al. | 285/322 |
| 5,417,291 | A | 5/1995 | Leising | |
| 6,059,042 | A * | 5/2000 | Huber et al. | 166/377 |
| 6,168,213 | B1 * | 1/2001 | Muller | 285/391 |
| 6,213,202 | B1 | 4/2001 | Read, Jr. | |
| 6,296,100 | B1 | 10/2001 | Schetter | |
| 6,481,498 | B1 * | 11/2002 | Ackroyd et al. | 166/242.6 |
| 6,893,054 | B2 | 5/2005 | Chen | |
| 7,123,655 | B2 * | 10/2006 | Kerofsky | 375/240.03 |

* cited by examiner

*Primary Examiner*—Hoang Dang
(74) *Attorney, Agent, or Firm*—Michael Flynn; David Cate; Robin Nava

(57) ABSTRACT

A connector is provided that enables connection between two parts without rotation of either of the two parts. The connector comprises a first part with N engagement members; a second part with N+1 engagement members; and a sleeve having a first and second end, the first end having N engagement members for engaging the N engagement members of the first part, the second end having N+1 engagement members for engaging the N+1 engagement members of the second end.

19 Claims, 8 Drawing Sheets

APPARATUS AND METHOD TO CONNECT TWO PARTS WITHOUT ROTATION

CROSS-REFERENCE TO RELATED APPLICATION

This application claims the benefit of provisional application U.S. Ser. No. 60/718,812, filed Sep. 20, 2005, incorporated by reference herein.

BACKGROUND

The present invention relates to connecting components. More specifically, the present invention provides an apparatus and method to connect two parts without rotating either of the parts in a string assembly.

In many oilfield related operations it can be desirable or necessary to form a connection between parts without rotating either. For example, in coiled tubing operations, a coiled tubing string is connected to a bottomhole assembly (BHA) which typically includes tools such as those needed for stimulating, fracturing, drilling, etc. In coiled tubing operations, the coiled tubing string is advanced into the well or withdrawn from the well using a coiled tubing injector head, as is known in the art. It is often necessary to connect the BHA which is fixed and cannot rotate (due to length/weight or being in a closed BOP ram) to the bottom of the coiled tubing which is hanging below the lubricator and is also unable to rotate.

There is, therefore, a need for a connector suitable for operations which does not require high levels of torque to make the connection yet which is able to transmit the torque encountered in across the joint.

SUMMARY OF THE INVENTION

An embodiment of the present invention provides connector for connecting two parts without rotating either of the two parts. The connector comprises a first part with N engagement members; a second part with N+1 engagement members; and a sleeve having a first and second end, the first end having N engagement members for engaging the N engagement members of the first part, the second end having N+1 engagement members for engaging the N+1 engagement members of the second end.

Another embodiment of the present invention provides a connector for connecting two parts without rotating either of the two parts, the connector comprising a first part with N engagement members; a second part with N−1 engagement members; and a sleeve having a first and second end, the first end having N engagement members for engaging the N engagement members of the first part, the second end having N−1 engagement members for engaging the N−1 engagement members of the second end.

Yet another embodiment of the present invention provides a connector to connect two parts without rotating either of said two parts, the connector comprising a first part having a set of distal engagement members on a distal end; a second part having a bore in a proximal end to receive the distal end of the first part, the proximal end of the second part having a set or proximal engagement members; and a first sleeve having a set proximal engagement members on a proximal end to engage with the set of distal engagement members of the first part and a set of distal engagement members on a distal end to engage with the set of proximal engagement members of the second part.

Still another embodiment of the present invention provides a method to connect two parts without rotating either of said two parts, the method comprising inserting a distal end of a first part axially into a bore in a proximal end of a second part; engaging a set of proximal engagement members on a proximal end of a first sleeve with a set of engagement members on the first part and a set of distal engagement members on a distal end of the first sleeve with a set of engagement members on the proximal end of the second part; and retaining the first sleeve to at least one of the first part and the second part.

DETAILED DESCRIPTION OF THE INVENTION

It should be understood that although the connection apparatus and method are described primarily with reference to downhole components, the tool has equal application to the connection of non-rotatable components in large rotary equipment, generators, coiled tubing injector connectors, large equipment axles, and the like. Accordingly, the terms proximal and distal used in describing the connection tool used in a downhole environment, can be replaced with upper/lower, left/right, 1st/2nd, etc., depending upon the application, orientation, or environment. Although rotation can be used to connect either end of a disconnected component of a connector (e.g., a mandrel and sub), the non-rotation of the two components forming the actual joint is the reason for the present application.

The present invention provides a connector that allows connection of two parts without relative rotation between the two parts and yet preserves the ability for the transmission of torque across the connection. The connector can preserve the full strength of the assembly with minimal backlash. Additionally, the connection tool utilizes a removable engagement sleeve to prevent damage to the engagement members during the stabbing process and allows easy replacement and/or dressing of damaged engagement members. Although the terms proximal and distal are used to recite spatial relationship of the components, the connector of the present invention can be used in any orientation.

In general, the connector of the present invention comprises components having mating engagement members. In the examples shown, the engagement members are castellations or splines but it should be understood that alternate types of mating elements such as teeth, protrusions, extensible members, etc., can be used to advantage by the present invention. In a particular embodiment, a first element has N engagement members, a second element has N+1 engagement members and a third element has N and N+1 engagement members to mate with the first and second elements. It should be understood that the first element (and likewise the second element) can act as either the proximal or the distal end of the assembled connection.

Figure 1:
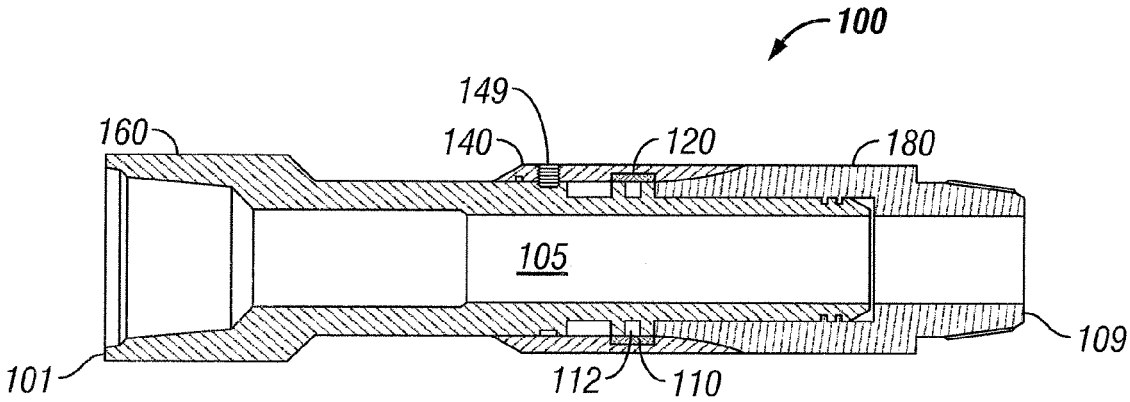
FIG. 1 is a cross-sectional view of an assembled connector, according to one embodiment of the invention.

One embodiment of a connector 100 of the present invention is illustrated in FIGS. 1-8B. FIG. 1 is a cross-sectional view of an assembled connector 100, according to one embodiment of the invention. Although the connector 100 is illustrated with a threaded connection on the proximal 101 and distal 109 ends, any means for connection can be used on either or both ends (101, 109), as is known to one of ordinary skill in the art. Further, either or both ends (101, 109) of connector 100 can be formed unitary with a component, for example, a BHA or coiled tubing.

In the embodiment shown, the connector 100 includes an engagement sleeve 120, a first element 160, second element 180, and a retention sleeve 140. The engagement sleeve 120 has engagement members 122 and 124 on the proximal and distal ends thereof. In the embodiment shown, the engagement members 122 on the proximal end are circumferentially spaced splines 122 and the engagement members 124 on the distal end are a set of castellations 124. It should be understood that the engagement members 122, 124 are not so limited to splines and castellations and the type and location of the engagement members is only limited to the orientation that is necessary to mate with engagement members on the first element 160 and the second element 180.

Figure 2A:
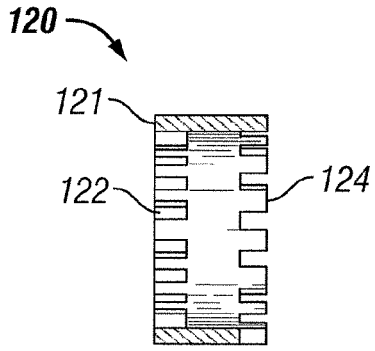
FIG. 2A is a cross-sectional view of an engagement sleeve of a connector, according to one embodiment of the invention.
Figure 2B:
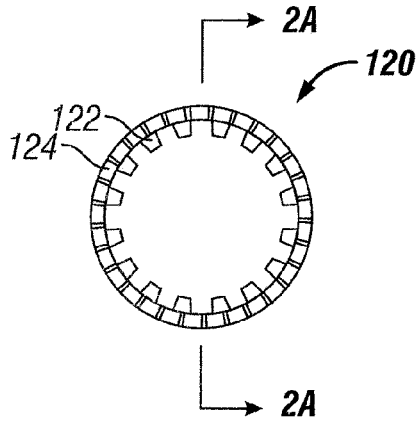
FIG. 2B is an axial perspective view of the engagement sleeve of FIG. 2A.

As shown more clearly in FIGS. 2A-2B, in this embodiment, the engagement members 124 are a set of axially extending castellations (e.g., tabs with voids therebetween) and the engagement members 122 are a set of splines that extend radially inward.

Figure 3:
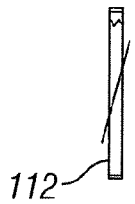
FIG. 3 is a cross-sectional view of a retainer ring of a connector, according to one embodiment of the invention.
Figure 4:
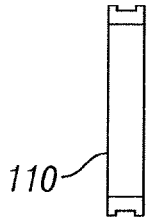
FIG. 4 is a cross-sectional view of a split ring of a connector, according to one embodiment of the invention.

FIG. 3 illustrates an optional retainer ring 112 used to retain an optional split ring 110, as shown in FIG. 4, circumferential the first element 160, as is further discussed below.

Figure 5:
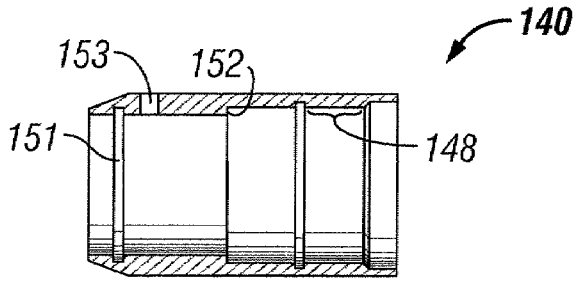
FIG. 5 is a cross-sectional view of a retention sleeve of a connector, according to one embodiment of the invention.

FIG. 5 is a cross-sectional view of a retention sleeve 140 having a threaded internal section 148 and an internal shoulder 152. Retention sleeve 140 further includes a groove 151 for a seal and a port 153 for a set screw 149.

Figure 6:
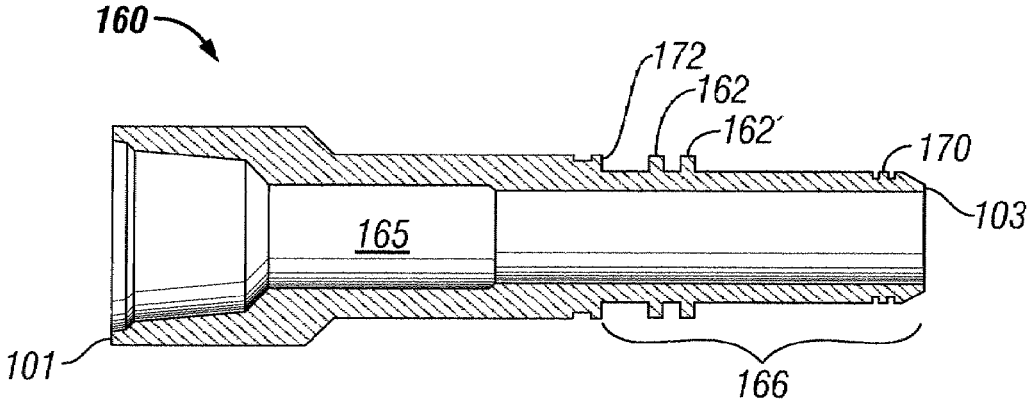
FIG. 6 is a cross-sectional view of a first element of a connector, according to one embodiment of the invention.

FIG. 6 is a cross-sectional view of an embodiment of the first element 160. In this embodiment, the engagement members 162 of the first element 160 are a set of external splines 162 disposed circumferential the outer surface of the first element 160. As discussed previously, the type and orientation of the engagement members 162 is dependent upon the type and orientation of the engagement members 122 on the engagement sleeve 120. It should be understood that although illustrated with a longitudinal bore 165, the first element 160 can be solid therethrough without departing from the spirit of the invention. The distal section 166 of the first element 160 preferably has an outer diameter less than the inner diameter of the engagement members 122 of the engagement sleeve 120 so as to allow disposition of the engagement sleeve 120 around the first element 160.

Figure 7:
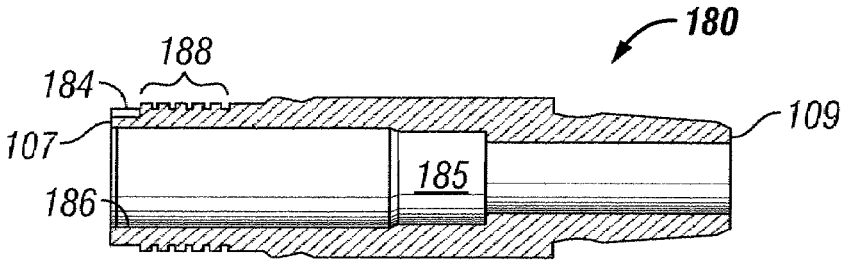
FIG. 7 is a cross-sectional view of a second element of a connector, according to one embodiment of the invention.
Figure 8A:
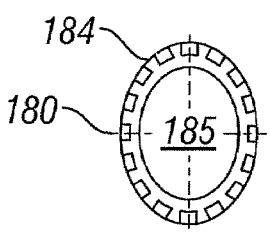
FIG. 8A is an axial perspective view of the proximal end of the second element of FIG. 7.
Figure 8B:
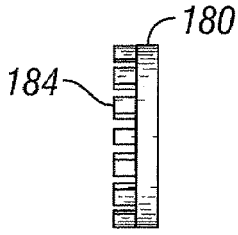
FIG. 8B is a side perspective view of the proximal end of the second element of FIG. 7.

FIG. 7 is a cross-sectional view of an embodiment of the second element 180 having a bore 186 to receive the distal end 103 of the first element 160, and optionally, a longitudinal bore 185 extending therethrough. It should be understood that depending upon the application, the second element 180 can be solid except for bore 186 without departing from the spirit of the invention. The proximal end 107 of the second element 180 has a set of engagement members 184. In the embodiment shown, the engagement members 184 are castellations for mating with the castellations 124 of engagement sleeve 120. As discussed previously, the type and orientation of the engagement members 184 is dependent upon the type and orientation of the engagement members 124 of the engagement sleeve 120. As shown more clearly in FIGS. 8A-8B, the engagement members 184 (e.g., plurality of circumferential slots and voids therebetween) extend axially. The threaded external section 188 can be included to connect with the threaded internal section 148 of the retention sleeve 140, as discussed below.

Referring to FIGS. 1-8B cumulatively, the use of the connector 100 to connect two parts without rotating either of the two parts is described. The term stabbing shall refer to axially disposing a first element into a second element. To form the connection with connector 100, a first element 160 and a second element 180 are provided. In a preferred embodiment, the proximal end 101 of the first element 160 is connected to one part or component and the distal end 109 of the second element 180 is connected to a second part or component, with relative rotation between the two parts impossible or undesirable, but some degree of axial movement achievable.

The distal section 166 of the first element 160 can then be axially disposed into the bore 185 in the proximal end 107 of the second element 180. To restrict relative rotation between the second element 180 and the first element 160 (e.g., for transmittal of torque), the engagement sleeve 120 is provided. The engagement sleeve 120 is axially disposed until the set of engagement members (e.g. castellations) 124 on the engagement sleeve 120 engage the set of engagement members (e.g. castellations) 184 of the second element 180 and the set of engagement members (e.g. internal splines) 122 of the engagement sleeve 120 engage the set of engagement members (e.g. external splines) 162 of the first element 160. The term engaged shall refer to the interlock or meshing of two components (e.g., two sets of castellations engaging or two sets of splines engaging) so as to transmit rotational torque across the engagement. Each set of engagement members (122, 162 and 124, 184) are preferably disposed at a uniform spacing along the circumference of the body they are mounted to, formed on, or formed in.

In a preferred embodiment, the engagement sleeve 120 utilizes a differential engagement member 122, 124 configuration (e.g., the number of proximal and distal end engagement members 122, 124 are not equal). For example, in the embodiment shown, the differential configuration of the engagement sleeve 120 includes N number of engagement members (e.g. internal splines) 122 and N+1 (or N−1)

engagement members (e.g. castellations) 124, and accordingly N engagement members (e.g. external splines) 162 on the first element 160 and N+1 (or N−1) engagement members (e.g. castellations) 184 on the second element 180. This differential engagement member 122, 124 arrangement can reduce the backlash therebetween.

For example, if an engagement sleeve 120 has sixteen diametral internal splines 122 and fifteen castellations 124, the differential configuration allows for minimal backlash at assembly. With the desired equal circumferential spacing, the sixteen splines 122 are spaced at 22.5 degree intervals and the fifteen castellations 124 are spaced at 24 degree intervals. With such a differential spline 122 and castellation 124 configuration, the rotational adjustment to align the voids and protrusions of the castellations (124, 184) and splines (122, 162) to allow engagement is (24−22.5)/2 or 0.75 degrees. A non-differential spline (i.e., having an equal number of splines and castellations) provides for more difficult arrangement. For example, if using a non-differential configuration (not shown) having sixteen splines 122 and sixteen castellations 124, the rotational adjustment to allow engagement of the castellations (124, 184) and splines (122, 162), respectively, is 22.5/2=11.25 degrees. Thus the above described differential configuration provides an adjustability roughly 15 times as fine as a non-differential (e.g., equal) configuration. A higher number of splines and castellations could be used, but this reduces the width of each spline and castellation which may not be sufficient for downhole or other high torque use.

The above mentioned adjustment translates into backlash required in the connector 100. For example, a 0.75 degree adjustment requires (π×4.123"×0.75°)/360° or 0.027" of spline clearance to allow the castellations (124, 184) and splines (122, 162) to engage, respectively. This is 8% of the tooth width which is minimal.

After the engagement sleeve 120 is installed on the assembly of the first element 160 and the second element 180 (e.g., the set of castellations 124 on the engagement sleeve 120 engage the set of castellations 184 of the second element 180 and the set of internal splines 122 of the engagement sleeve 120 engage the set of external splines 162 of the first element 160) relative rotation therebetween is restricted. The engagement sleeve 120 can then be axially restricted from moving by any means known the art, which can include retaining the engagement sleeve 120 to at least one of the first element 160 or the second element 180. In the illustrated embodiment, axial movement of the engagement sleeve 120 is restricted by an optional retention sleeve 140 (see FIGS. 1 and 5).

The retention sleeve 140 includes an internal shoulder 152 to abut the proximal end 121 of the engagement sleeve 120, and thus the axial restriction of the retention sleeve 140 will retain the engagement sleeve 120 in an engaged position. In the illustrated embodiment, the retention sleeve 140 can be axially disposed circumferential the first element 160, the second element 180, and the engagement sleeve 120, and the threaded internal section 148 of the retention sleeve 140 threaded to the threaded external section 188 of the second element 180 to form the axial interlock. So assembled, the connector 100 can transmit axial loads, tensile loads, and torque across the connector 100. Although not shown, the retention sleeve 140 can be threadably connected to the first element 160, in addition to or in substitute of the threaded connection between the retention sleeve 140 and the second element 180, without departing from the spirit of the invention. Optionally, or in substitute to a threaded connection between the retention sleeve 140 and the second element 180, at least one set screw 149 can be engaged to the first element 160 to further inhibit threads 148 of the retention sleeve 140 from disengaging the threads 188 of the second element 180. The retention sleeve 140 is installed at a relatively low level of rotational torque as compared to the torque required to assemble conventional threaded connectors of a drill string (e.g., a box and pin), which can be advantageous when the use of high torque tongs is not possible, for example, when a connection is below a coiled tubing injector.

Optionally, at least one seal can be used. For example, a seal can be disposed in a groove 170 on the distal section 166 of the first element 160 to seal the first element 160 to the bore 186 of the second element 180. A seal can be used between any of the components of any embodiment without departing from the spirit of the invention.

During some operations, for example, pullout operations, there can be a high degree of axial misalignment between the first element 160 (and anything attached thereto) and the second element 180 (and anything attached thereto). After the retention sleeve 140 is unscrewed, as the distal section 166 of the first element 160 is retracted from the bore 186 of the second element 180, the engagement sleeve 120 is automatically disengaged.

The invention can provide a means to retain the engagement sleeve 120 to the first element 160, if so desired. Referring again to FIG. 6, a first element 160 can include a second set of engagement members (e.g. external splines) 162' disposed between the first set of engagement members (e.g. external splines) 162 and the distal end 103 of the first element 160. The second set of engagement members 162' preferably has the same configuration as the first set of engagement members 162 of the first element 160. Such an arrangement allows the engagement sleeve 120 to axially traverse the sets (162, 162') of engagement members. The engagement sleeve 120 can be installed, with the set of engagement members (e.g. castellations) 124 oriented away from the first element 160, onto the distal section 166 of the first element 160. In the embodiment shown, the inner diameter of the engagement sleeve 120 bore (e.g., the diameter at the voids between the splines 122) is greater than the outer diameter of the external splines (162, 162') to allow the engagement sleeve 120 to be slidably disposed from the distal end 103 of the first element 160 to the area between the first element shoulder 172 and the first set of external splines 162. A first element shoulder 172 is not required, any protuberance, for example, a ring, can be utilized to restrict the proximal travel of the engagement sleeve 120.

To retain the distal movement of the engagement sleeve 120 in the area between the first element shoulder 172 and the first set of engagement members 162, an optional retainer ring 112 retains a split ring 110, as shown in FIG. 4, circumferential the first element 160. A split ring 110, which can be two or more pieces, is disposed circumferential the outer surface of the distal section 166 of the first element 160 between the first set of engagement members 162 and the second set of engagement members 162'. A retention ring 112 can be disposed around the outer circumference of the split ring 110, for example, in a groove as shown. The retention ring 112 is retained by any means know in the art. Preferably the split ring 110 has an inner diameter similar to that of the outer diameter of the distal section 166 of the first element 160 and an outer diameter similar to the outer diameter of the sets of engagement members (162, 162'). So configured, the second set of engagement members 162' impedes the distal axial movement of the retainer ring 112 and split ring 110 assembly. As the outer diameter of the retainer ring 112 and split ring 110 assembly extends to at least the height of the sets of engagement members (162, 162'), the set of engagement members 122 of the engagement sleeve 120 inhibit the axial displacement of the engagement sleeve 120 (and the retention sleeve 140 if present) past the retainer ring 112 and split ring 110 assembly, and thus the engagement sleeve 120 is slidably retained on the first element 160. Although illustrated with a split ring 110 and retention ring 112, any ring which inhibits the axial displacement of the engagement sleeve 120 can be used. Further, any means for slidably retaining the engagement sleeve 120 to the first element 160 can be utilized without departing from the spirit of the invention.

If so desired, the retention sleeve 140 can be installed prior to slidably retaining the engagement sleeve 120 to the first element 160. By utilizing a retention sleeve 140 that cannot be slidably disposed past the engagement sleeve as shown (e.g., shoulder 152), the slidable retention of the engagement sleeve 120 to the first element 160 further slidably retains the retention sleeve 140 to the first element 160, which has obvious safety and assembly benefits.

Retention sleeve 140 can also include an optional groove 151 for insertion of a seal. A seal retained in groove 151 can frictionally retain the retention sleeve 140 at any point along the outer surface of the first element 160, for example, to retain the retention sleeve 140 away from the distal end 103 of the first element 160 during makeup, typically when the first element 160 is the upper connection and the second element 180 is the lower connection. To disconnect the connector 100, the retention sleeve 140 is disconnected to allow axial movement and the first element 160 and the second element 180 can be axially separated. As configured in the illustrated embodiment, the retention sleeve 140 and the engagement sleeve 120 remain slidably disposed to the first element 160, even during disconnection, and thus have obvious safety, assembly, and disassembly advantages.

Figure 9:
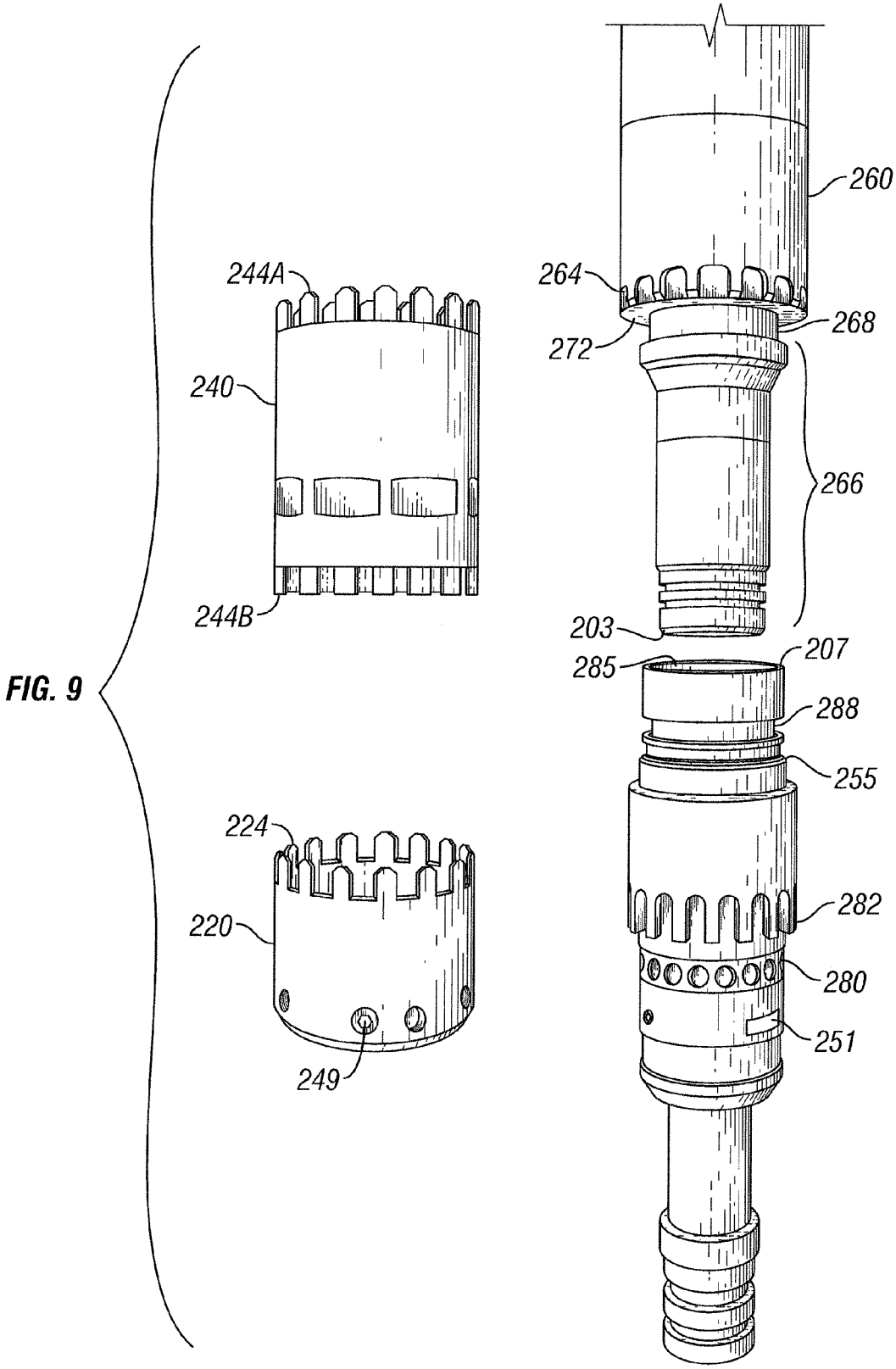
FIG. 9 is an exploded perspective view of a connector, according to an embodiment of the invention.

An alternate embodiment of the connection tool 200 of the present invention is shown in FIGS. 9-16. FIG. 9 illustrates several of the key components of the connector 200 before installation, including a first element 260, a second element 280, a first engagement sleeve 240, and a engagement second sleeve 220, typically with a differential configuration. Although varying in mechanical design, the overall principles of a differential configuration second engagement sleeve 220, preferably with N number of engagement members (e.g. internal splines) 222 and N+1 (or N−1) engagement members (e.g. castellations) 224, remain as discussed above.

Figure 10:
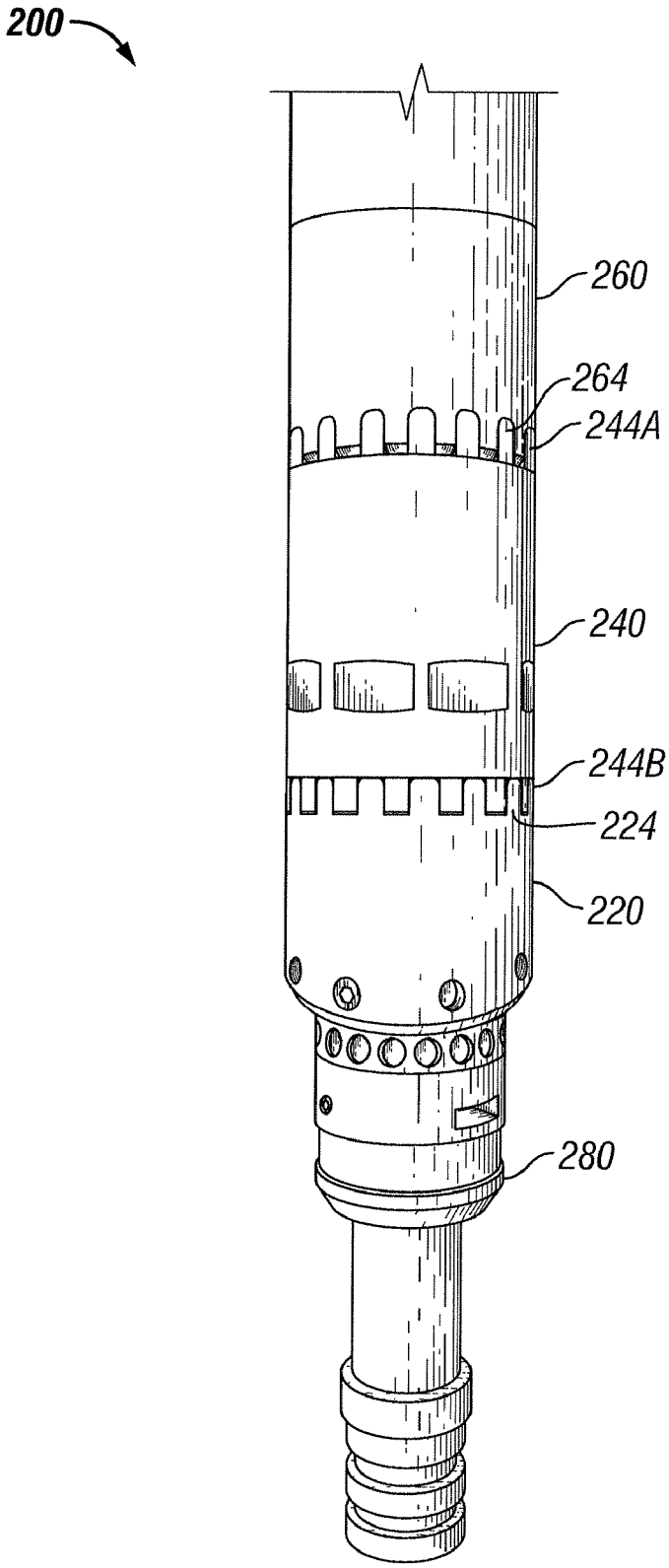
FIG. 10 is a perspective view of the assembled connector of FIG. 9.
Figure 11:
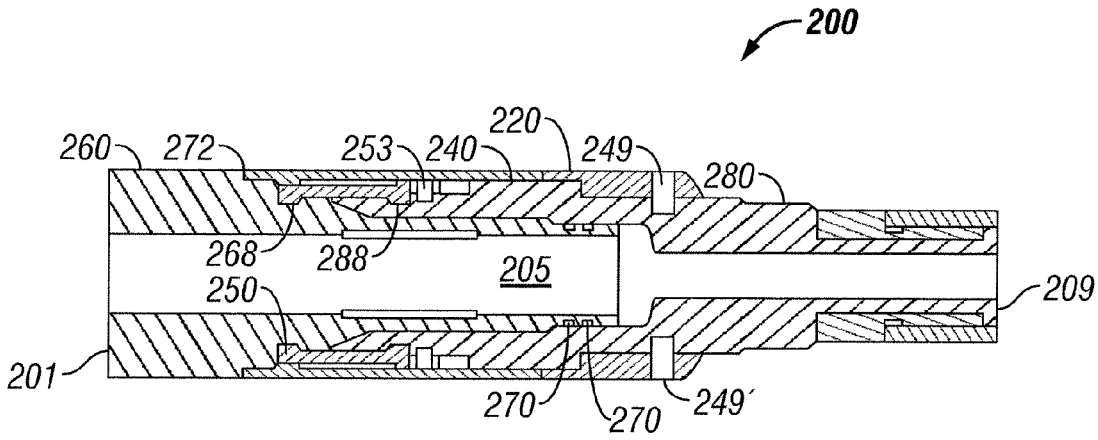
FIG. 11 is a cross-sectional view of an assembled connector, according to an embodiment of the invention.
Figure 12:
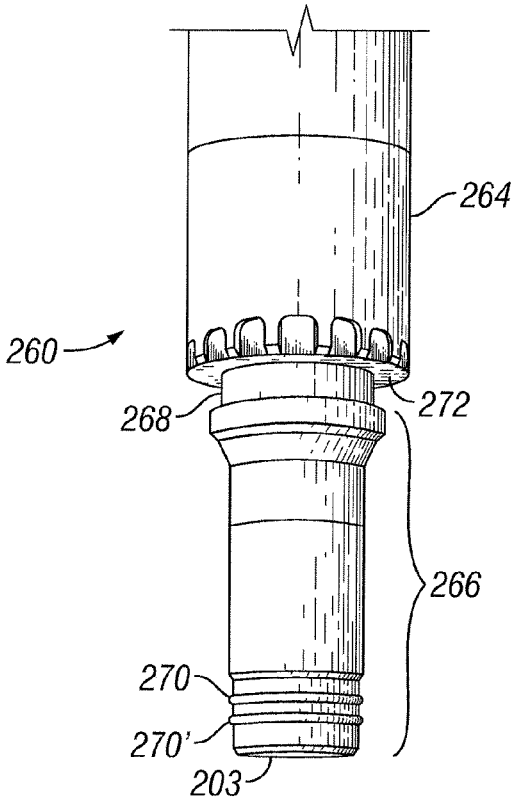
FIG. 12 is a perspective view of a first element of a connector, according to an embodiment of the invention.
Figure 13:
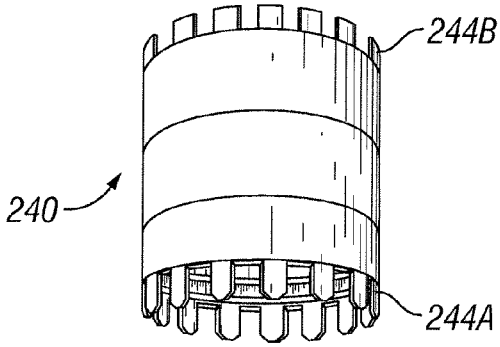
FIG. 13 is a perspective view of a first engagement sleeve of a connector, according to an embodiment of the invention.
Figure 14:
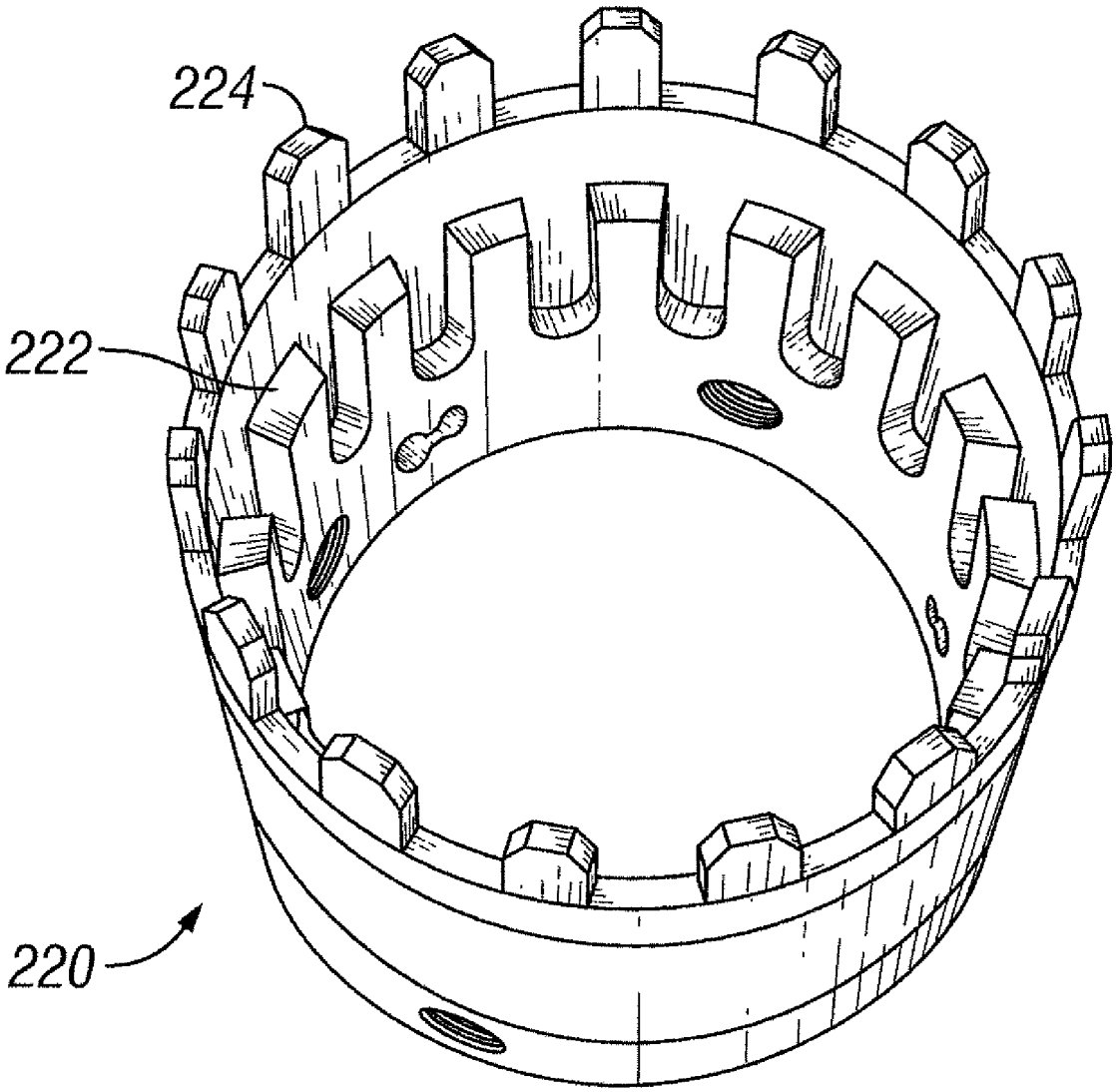
FIG. 14 is a perspective end view of a second engagement sleeve of a connector, according to an embodiment of the invention.

FIG. 10 is a perspective view and FIG. 11 a cross-sectional view of connector 200 fully assembled and engaged. The first element 260 includes a shoulder 272 adjacent the narrow distal section 266 and a set of engagement members (e.g. castellations) 264 in the shoulder 272. The second element 280 includes a bore 285 in a proximal end 207 for receiving the narrow distal section 266 of the first element 260, a groove 255 on the outer surface to receive a retainer spring 253, a profile 288 on the outer surface to receive a collet 250 to form an axial interlock, as discussed below, and a set of engagement members (e.g. external splines) 282. The first engagement sleeve 240 includes a set of engagement members (e.g. castellations) 244A on a proximal end and a set of engagement members (e.g. castellations) 244B on a distal end. The number of engagement members on the proximal and distal end can differ or be the same. The second engagement sleeve 220 includes a set of engagement members (e.g. castellations) 224 on a proximal end and a set of engagement members (e.g. internal splines) 222 in a bore thereof, as seen more readily in FIG. 14. The connector 200 can include a longitudinal bore 205 therethrough, but is not required.

The cross-sectional view of the connector 200 in FIG. 11 illustrates the connector as engaged and thus capable of transmitting rotational torque. To restrict axial movement between the first element 260 and the second element 280, a collet 250 is supplied. At least one proximal finger of collet 250 engages a profile 268 in the first element 260 and at least one distal finger of collet 250 engages a profile 288 of the second element 280. In the illustrated embodiment, the first engagement sleeve 240 is circumferential to the collet 250 and radially retains the collet 250 fingers in the respective profiles (268, 288). The engagement members 244A on the proximal end of the first engagement sleeve 240 engage the engagement members 264 in the first element 260 to restrict relative rotation therebetween. The engagement members 244B on the distal end of the first sleeve 240 engage the engagement members 224 on the proximal end of the second sleeve 220. As the engagement members 222 engage the engagement members 282 of the second element 280, the second element 280 and the first element 260 are rotationally connected through the second engagement sleeve 220 and the first engagement sleeve 240 assembly, and thus allow the transmittal of torque. Optionally, the distal end of the collet 250 and the proximal end of the bore of the first sleeve 240 can include the respective protuberances illustrated in FIG. 11 to form a stop to limit the distal axial travel of the first engagement sleeve 240 to prevent distal collet fingers from disengaging the profile 288 of the second element 280. A seal can be included between any of the components, for example, a seal in a groove (270, 270') in the first element 260 to seal the first element 260 to the bore 285 of the second element 280.

Figure 15:
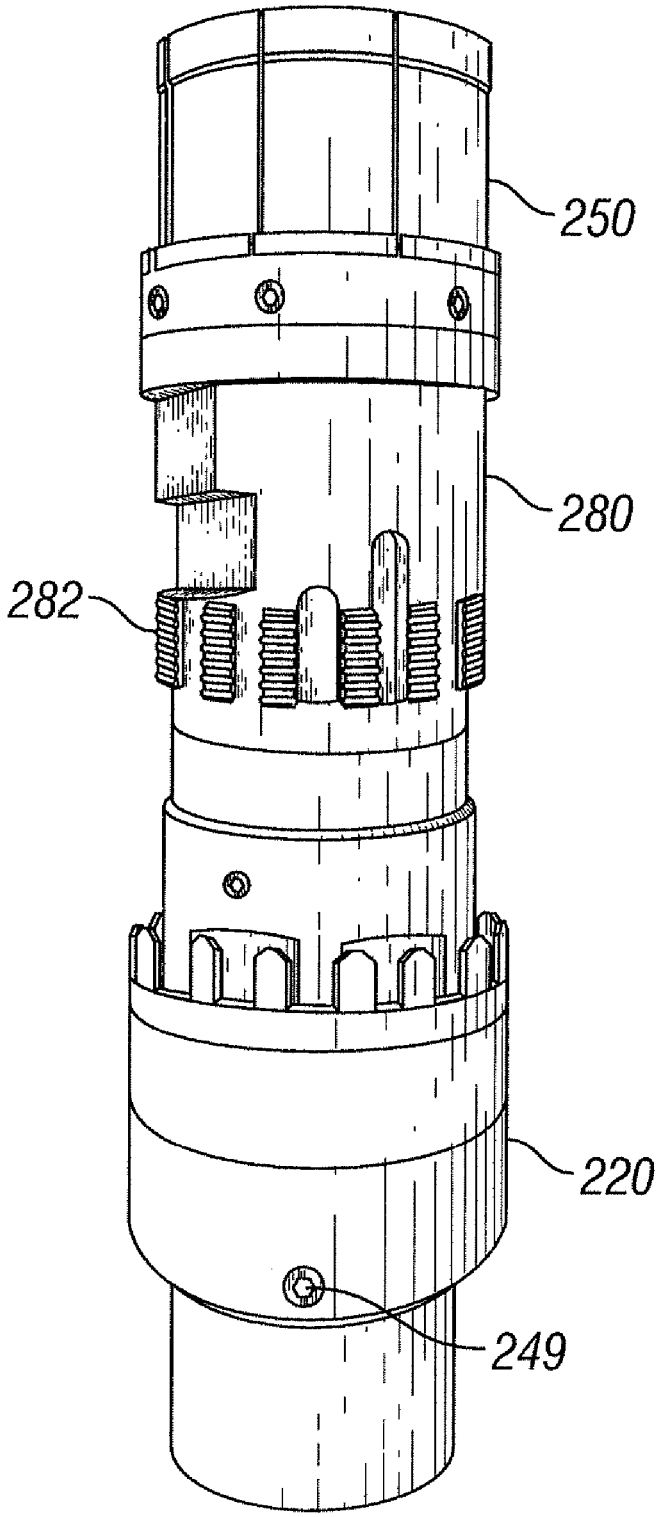
FIG. 15 is a perspective view of a second element of a connector having a collet and a second engagement sleeve mounted thereto, according to an embodiment of the invention.
Figure 16:
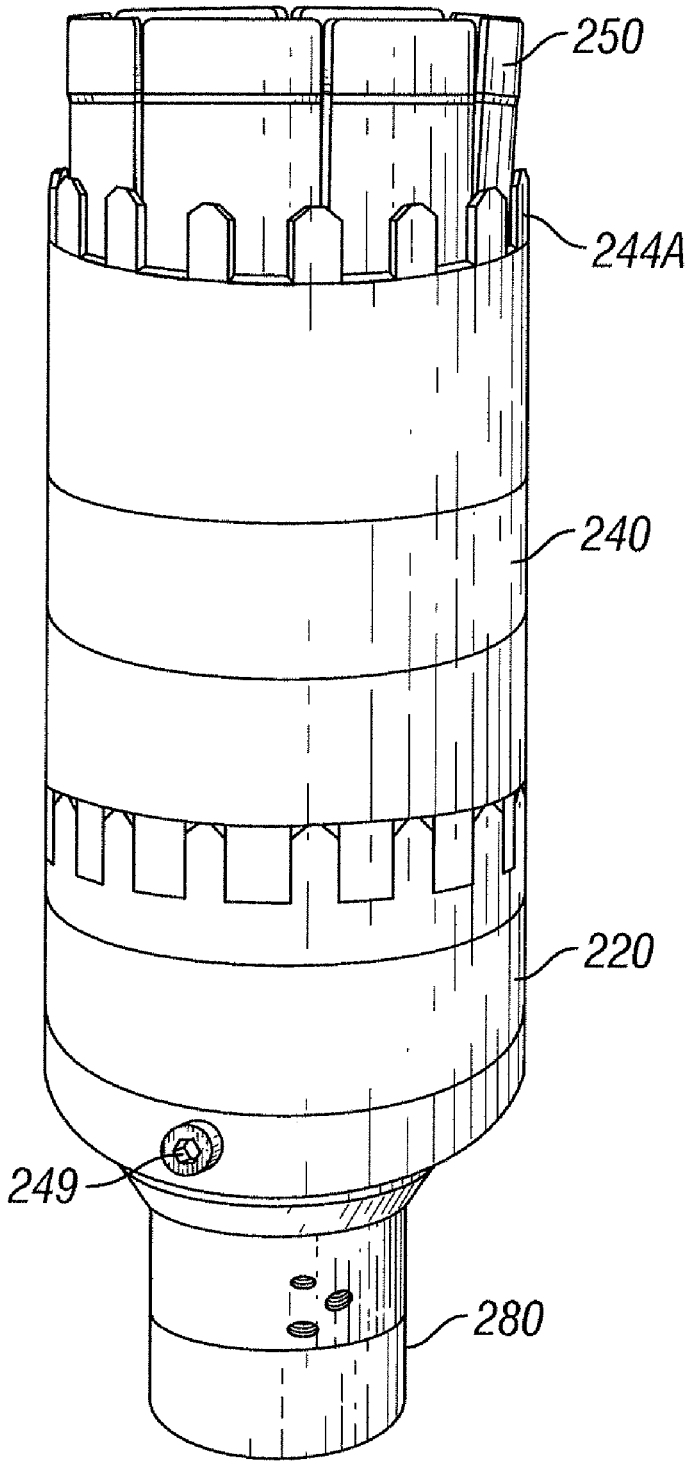
FIG. 16 is a perspective view of a second element of a connector having a collet and a second engagement sleeve engaging a first engagement sleeve mounted thereto, according to an embodiment of the invention.

Before engagement, it can be desirable to preassemble several of the components. Turning now to FIGS. 15-16, one embodiment of preassembly is described. Collet 250, which can be a unitary piece having proximal and distal fingers or a plurality of separate fingers as is known to one of ordinary skill in the art, is provided. Distal collet 250 fingers are then disposed in the profile 288 formed on the second element 280. If collet 250 comprises a plurality of separate collet fingers as shown in FIG. 15, the distal collet fingers can be retained within the profile 288 by any means, which can include a circumferential band, for example, tape. The first engagement sleeve 240 can then be slidably displaced over the collet 250 and the second element 280 as shown in FIG. 16. The inner bore of the first engagement sleeve 240 is of appropriate size to retain the distal collet fingers in the profile 288. An optional retainer spring 253 disposed in groove 255 can provide resistance to axial movement to retain the first engagement sleeve 240 in a desired position on the second element 280. The second engagement sleeve 220 can be disposed on the distal end 209 of the second element 280, and retained along the second element 280 by at least one set screw (249, 249'). In the illustrated embodiment, the second engagement sleeve 220 is preferably disposed on the second element 280 before the distal end 209 of the second element 280 is connected to a part or component.

To use the preassembled components above to form a connector 200, the proximal end 201 of the first element 260 is connected to one part or component and the distal end 209 of the second element 280 is connected to a second part or component, with relative rotation between the two parts impossible or undesirable, but some degree of axial movement possible. Before the first element 260 is stabbed into the second element 280, the first engaement sleeve 240 is preferably disposed on the second element 280 so that the distal fingers of the collet 250 are retained in the profile 288 of the second element 280, but the proximal fingers of the collet 250 are not restricted from any outward radial movement to allow the proximal fingers to engage the profile 268 in the first element 260, as shown in FIG. 16. In this first position, the first engagement sleeve 240 is disposed closer to the proximal end 209 of the second element 280 than when in the engaged (e.g., second) position and thus the second engagement sleeve 220 is disposed closer to the proximal end 209 of the second element 280 as compared to the engaged position.

The narrow distal section 266 of the first element 260 can then be stabbed into the bore 285 of the second element 280 until reaching a desired insertion, preferably when the proximal fingers of the collet 250 are adjacent the profile 268 in the first element 260. The first engagement sleeve 240 can then be axially disposed towards the proximal end 201 of the second element 280 until the inner bore of the first engagement sleeve 240 is circumferential the collet 250, and thus retaining both the proximal and distal fingers of the collet 250 in the respective profiles (268, 288) of the first element 260 and the second element 280. So assembled, the first element 260 and the second element 280 are axially connected to each other but not rotationally connected. The first engagement sleeve 240 is axially disposed and/or rotated until the proximal set of engagement members 244A are engaged with the set of engagement members 264 formed in the first element 260. The second engagement sleeve 220 can then similarly be axially disposed towards the proximal end 201 of the first element 260. The engagement sleeve 220 is engaged to the second element 280 and the first engagement sleeve 240 by axially disposing and/or rotating the engagement sleeve 220 until the engagement members 224 of the engagement sleeve 220 engage the distal set of engagement members 244B of the first engagement sleeve 240 and the engagement members 222 (see FIG. 14) of the second engagement sleeve 220 engage the engagement members 282 (see FIG. 9) of the second element 280. At least one set screw (249, 249') can then be disposed into engagement with the second element 280 to restrict axial movement of the second engagement sleeve 220. Preferably any tensile loads between the first element 260 and the second element 280 are transmitted therebetween (as shown) and not transmitted to the set screw 249. Optionally, the second element 280 can include at least one recess 251 to receive the distal end of at least one set screw (249, 249'), as shown more readily in FIG. 9. So assembled, the first element 260 is affixed to the second element 280 rotationally and axially. Disassembly includes reversing the above steps.

As previously discussed in reference to the embodiment of FIG. 1-8B, an engagement sleeve 220 of the embodiment of FIGS. 9-16 preferably has a differential configuration with respect to the number of engagement members 222 and engagement members 224. For example, in one embodiment, the differential configuration of the second engagement sleeve 220 includes N number of internal splines 222 and N+1 (or N−1) castellations 224, and accordingly N external splines 282 on the first element 280 and N+1 (or N−1) distal castellations 244B on the first engagement sleeve 240. The number of proximal castellations 244A on the first engagement sleeve 240, and accordingly the number of castellations 264 on the first element 260, can be selected independently.

Numerous embodiments and alternatives thereof have been disclosed. While the above disclosure includes the best mode belief in carrying out the invention as contemplated by the named inventors, not all possible alternatives have been disclosed. For that reason, the scope and limitation of the present invention is not to be restricted to the above disclosure, but is instead to be defined and construed by the appended claims.

What is claimed is:

1. A connector for connecting two parts without rotating either of the two parts, comprising:

a first part with N engagement members;

a second part with N+1 engagement members; and a sleeve having a first and second end, the first end having N engagement members for engaging the N engagement members of the first part, the second end having N+1 engagement members for engaging the N+1 engagement members of the second end.

2. The connector of claim 1, further comprising a retention device for maintaining the engagement of the engagement members of the sleeve with the engagement members of the first part and the second part.

3. The connector of claim 1, wherein the N engagement members are splines.

4. The connector of claim 1, wherein the N engagement members are castellations.

5. The connector of claim 1, wherein the N+1 engagement members are splines.

6. The connector of claim 1, wherein the N+1 engagement members are castellations.

7. The connector of claim 1, wherein the first part is connected to coiled tubing.

8. The connector of claim 1, wherein the first part is connected to a bottom hole assembly.

9. A connector for connecting two parts without rotating either of the two parts, comprising:

a first part with N engagement members;

a second part with N−1 engagement members; and a sleeve having a first and second end, the first end having N engagement members for engaging the N engagement members of the first part, the second end having N−1 engagement members for engaging the N−1 engagement members of the second end.

10. A connector to connect two parts without rotating either of said two parts comprising:

a first part having a set of distal engagement members on a distal end;

a second part having a bore in a proximal end to receive the distal end of the first part, the proximal end of the second part having a set or proximal engagement members;

a first sleeve having a set proximal engagement members on a proximal end to engage with the set of distal engagement members of the first part and a set of distal engagement members on a distal end to engage with the set of proximal engagement members of the second part; and a second sleeve removably connected to at least one of the first part and the second part, the second sleeve having an internal shoulder abutting a proximal end of the first sleeve to retain the sets of engagement members in engagement.

11. The connector of claim 10 wherein the first sleeve comprises N proximal engagement members and N+1 distal engagement members.

12. The connector of claim 11 wherein the first part comprises N distal engagement members and the second part comprises N+1 proximal engagement members.

13. The connector of claim 10 wherein the first sleeve comprises N proximal engagement members and N−1 distal engagement members.

14. The connector of claim 13 wherein the first part comprises N distal engagement members and the second part comprises N−1 proximal engagement members.

15. A method to connect two parts without rotating either of said two parts, the method comprising:

inserting a distal end of a first part axially into a bore in a proximal end of a second part;

engaging a set of proximal engagement members on a proximal end of a first sleeve with a set of engagement members on the first part and a set of distal engagement members on a distal end of the first sleeve with a set of engagement members on the proximal end of the second part; and retaining the first sleeve to at least one of the first part and the second part and connecting a second sleeve to at least one of the first part and the second part, the second sleeve having an internal shoulder abutting a proximal end of the first sleeve to retain the sets of engagement members in engagement.

16. The method of claim 15 wherein the first sleeve comprises N proximal engagement members and N+1 distal engagement members.

17. The method of claim 16 wherein the first part comprises N engagement members and the second part comprises N+1 engagement members.

18. The method of claim 15 wherein the first sleeve comprises N proximal engagement members and N−1 distal engagement members.

19. The method of claim 18 wherein the first part comprises N engagement members and the second part comprises N−1 engagement members.

* * * * *